US010166423B2

(12) United States Patent
Januszek

(10) Patent No.: US 10,166,423 B2
(45) **Date of Patent: *Jan. 1, 2019**

(54) SUPPORT APPARATUS FOR PLYOMETRIC EXERCISE

(71) Applicant: Escape Fitness Limited, Peterborough (GB)

(72) Inventor: Matthew Januszek, Peterborough (GB)

(73) Assignee: Escape Fitness Limited, Cambridge (GB)

( * ) Notice: Subject to any disclaimer, the term of this patent is extended or adjusted under 35 U.S.C. 154(b) by 182 days.

This patent is subject to a terminal disclaimer.

(21) Appl. No.: 15/336,692

(22) Filed: Oct. 27, 2016

(65) Prior Publication Data

US 2017/0043201 A1 Feb. 16, 2017

Related U.S. Application Data

(63) Continuation of application No. 14/621,304, filed on Feb. 12, 2015, now Pat. No. 9,480,870.

(51) Int. Cl.
*A63B 21/00* (2006.01)
*A63B 6/00* (2006.01)
(Continued)

(52) U.S. Cl.
CPC ..... *A63B 21/00047* (2013.01); *A63B 5/00* (2013.01); *A63B 6/00* (2013.01);
(Continued)

(58) Field of Classification Search
None
See application file for complete search history.

(56) References Cited

U.S. PATENT DOCUMENTS 3,262,134 A 7/1966 Bramble
3,995,846 A * 12/1976 Frick ..... A61F 15/005 5/646

(Continued)

FOREIGN PATENT DOCUMENTS

EP 0128354 A2 12/1984
GB 2501613 A 10/2013
WO 2004024240 A1 3/2004

OTHER PUBLICATIONS

Torque Fitness X-Series TRIPLEPLYO 3-in-1 Soft Plyo Cube [online]. Ironcompany Fitness Equipment [retrieved on Aug. 16, 2017]. Retrieved from the Internet: <URL: https://www.amazon.com/Torque-Fitness-TRIPLEPLYO-Soft-Plyo/dp/B01KYMSMHQ/ref=sr_1_1?ie=UTF8&qid=1502906023&sr=8-1&keywords=Torque++Fitness+X-Series+TRIPLEPLYO>.

(Continued)

*Primary Examiner* — Stephen R Crow
(74) *Attorney, Agent, or Firm* — Maine Cernota & Rardin

(57) ABSTRACT

A support apparatus for use during plyometric exercise. The apparatus includes a resilient body having a cuboid shape. A flexible cover is provided that surrounds the body. The cuboid body has a height, width and depth which are all of different lengths to each other such that the apparatus may be arranged in three different orientations in which an uppermost face defines a landing platform of three different heights. The body includes a foam core and a shock absorbing layer located at and bonded to the outer surface of the core that surrounds and encapsulates the core. The shock absorbing layer is formed of a foam material having a density greater than the foam core and is located at all six sides of the apparatus such that an intermediate layer is located at the upper face of the apparatus to define a landing platform whatever the orientation of the apparatus.

17 Claims, 2 Drawing Sheets

(51) Int. Cl.

| | |
|---|---|
| ***A63B 23/04*** | (2006.01) |
| ***A63B 5/00*** | (2006.01) |
| *A63B 71/00* | (2006.01) |
| *A63B 5/12* | (2006.01) |

(52) U.S. Cl.
CPC ..... *A63B 23/0458* (2013.01); *A63B 5/12* (2013.01); *A63B 2071/0063* (2013.01); *A63B 2209/00* (2013.01); *A63B 2225/093* (2013.01)

(56) References Cited

U.S. PATENT DOCUMENTS 4,137,583 A 2/1979 Baldwin et al.
4,147,828 A 4/1979 Heckel et al.
4,263,727 A 4/1981 Bender et al.
4,357,725 A 11/1982 Ahlm
4,471,767 A * 9/1984 Guimond ..... A47D 15/008 128/873
4,558,553 A * 12/1985 Kolk ..... A47B 95/043 108/27
4,758,195 A 7/1988 Walsh
4,817,902 A * 4/1989 Mason ..... A47B 95/043 108/27
4,873,734 A * 10/1989 Pollard ..... A47C 21/08 5/425
4,901,453 A 2/1990 Gaynor
4,968,025 A * 11/1990 Edkins ..... A63B 3/00 482/23
5,093,931 A 3/1992 LaBerge et al.
D136,977 S 1/1994 Petrullo
5,458,522 A 10/1995 Brooks, III
5,479,864 A * 1/1996 Kemp ..... A47B 13/083 108/27
D369,438 S 4/1996 Resler
5,525,384 A * 6/1996 Gilmore ..... A47B 95/043 248/345.1
5,620,325 A 4/1997 Glick
5,639,072 A * 6/1997 McCall ..... A47B 95/043 248/345.1
D394,930 S 6/1998 Creske
D444,177 S 6/2001 Carretta
6,601,253 B1 * 8/2003 Tarquinio ..... A47C 21/08 5/727
7,246,568 B1 7/2007 Cheung
D566,430 S 4/2008 Austin et al.
7,445,833 B2 11/2008 Polley
D666,772 S 9/2012 Park
8,287,437 B1 10/2012 Rovere
D728,695 S 5/2015 Chase et al.
D740,378 S 10/2015 Walsh-Gomez
D740,442 S 10/2015 Cohen et al.
D754,266 S 4/2016 Ross
9,480,870 B2 * 11/2016 Januszek ..... A63B 5/00
D778,167 S 2/2017 Mochizuki et al.
2003/0109364 A1 * 6/2003 Weir ..... A63B 21/078 482/142
2005/0124468 A1 6/2005 Wong
2012/0049460 A1 3/2012 Little
2013/0137558 A1 * 5/2013 Ross ..... A63B 5/16 482/142
2014/0150170 A1 6/2014 Kim
2014/0329044 A1 11/2014 Fantin
2015/0096120 A1 * 4/2015 Scarleski ..... A47C 31/105 5/484
2015/0196799 A1 * 7/2015 Chua ..... A63B 23/1236 482/141
2015/0231436 A1 * 8/2015 Januszek ..... A63B 5/00 482/142
2015/0284526 A1 10/2015 Yoshida
2017/0050101 A1 * 2/2017 Ruscombe-King ..... A63B 5/16
2018/0229098 A1 * 8/2018 McCorkle ..... A63B 71/0054

OTHER PUBLICATIONS

Extended European Search Report for related European Patent Application No. 15154633.0 dated Jul. 6, 2015.
Examination Report for related United Kingdom Patent Application No. 1402606.6 dated Nov. 10, 2015.
Examination Report for related United Kingdom Patent Application No. 1402606.6 dated Nov. 10, 2016.
UK Search Report in Priority GB Application No. GB1402606.6.
http://www.roguefitness.com/rogue-flat-pack-games-box; (Rogue Fitness) 3-in-1 Plyo box, dated at least Apr. 16, 2012.
http://www.mansionathletics.com/soft-plyoboxes-24-inc-ta224-hurdles-plyometrics.html; (Mansion Athletics) Polyethylene plyo boxes, see catalog page for images. Dated Sep. 26, 2013.

* cited by examiner

SUPPORT APPARATUS FOR PLYOMETRIC EXERCISE

CROSS REFERENCE TO RELATED APPLICATIONS

This application is a continuation of U.S. patent application Ser. No. 14/621,304, filed 12 Feb. 2015, which claims the benefit of UK Patent Application No. 1402606.6, filed 14 Feb. 2014, the entire contents and substance of which are hereby incorporated by reference.

BACKGROUND OF THE INVENTION

1. Field of the Invention

The present invention relates to a support apparatus for plyometric exercise, and in support apparatus providing multiple support platform surfaces of varying heights.

2. Description of Related Art

Plyometrics is a form of exercise performed by athletes to generate fast, powerful movements, either for improving performance in particular sport or to improve fitness generally. Plyometrics involve 'explosive' movements such as jumping or sudden bursts of acceleration which cause the muscle to be rapidly loaded and then contracted. The aim of plyometrics is to create the greatest amount of force in the shortest amount of time, resulting in stronger muscles and improved athletic performance. Plyometrics can help in building speed and strength to improve a person's performance of a specific action such as jumping, running or throwing.

A plyometric box, or plyo box, is an exercise apparatus that is used to facilitate the performance of certain plyometric exercises. The plyo box provides a raised stable platform for a person to jump onto and off. A typical plyometric exercise involves a person jumping with both feet onto the platform from a standing start on the ground and then jumping of the plyo box to return to the start position. Traditional plyo boxes comprise a wooden or metal frame supporting a rigid platform. Such rigid boxes are generally provided in a wide range of sizes and are nestable for storage. A disadvantage which such boxes is the risk of injury to the user if they slip or fail to correctly land on the platform while performing the exercise. It is known to provide boxes formed from foam or similar material. Such 'soft' boxes do not injure the user if they happen to fall onto the boxes.

Plyo boxes are provided in varying heights to vary the difficulty of the exercises by varying the jump height, and to accommodate persons of varying heights. Multiple plyo boxes may also be stacked to provide varying heights. However, the requirement to provide multiple plyo boxes of varying heights or multiple stacking plyo boxes requires the purchase of multiple boxes and the space to store these boxes.

It is therefore desirable to provide an improved exercise apparatus for plyometric exercise which addresses the above described problems and/or which offers improvements generally.

BRIEF SUMMARY OF THE INVENTION

According to the present invention there is provided an exercise apparatus as described in the accompanying claims.

In an embodiment of the invention there is provided a support apparatus for use during plyometric exercise. The apparatus comprises a resilient body having a cuboid shape. A flexible cover is provided that surrounds the body. The cuboid body has a height, width and depth which are all of different lengths to each other such that the apparatus may be arranged in three different orientations in which the uppermost face defines a landing platform of three different heights. The body comprises a foam core and a shock absorbing layer located at and bonded to the outer surface of the core that surrounds and encapsulates the core. The shock absorbing layer being formed of a foam material having a density greater than the foam core and is located at all six sides of the apparatus such that the intermediate layer is located at the upper face of the apparatus to define a landing platform whatever the orientation of the apparatus. In this way, the apparatus may be rotated onto any of the six faces to define one of three different heights. In whichever orientation eth apparatus is rotated, there will always be a layer of the denser intermediate material adjacent the upper surface. In addition, the uppermost section of the intermediate layer will always be supported vertically at its outer edges by four further sides of the intermediate layer.

An outer cushioning layer may surround and encapsulate the shock absorbing layer between the intermediate layer and the flexible cover to provide the apparatus with a soft feel to further limit abrasion and/or impact injuries.

The outer cushioning layer is preferably bonded to the shock absorbing layer, thereby ensuring that the integrity of the structure is better maintained in use.

The foam core is preferably formed of a PR foam material that provides the required structural support while minimizing weight and cost.

The shock absorbing layer may be formed of a foam material having a density of between 100 $kgm^{-3}$ and 140 $kgm^{-3}$. The shock absorbing layer is formed of a foam material having a density of between 120 $kgm^{-3}$.

The outer cushioning layer may be formed of a foam material having a density of between 20 $kgm^{-3}$ and 40 $kgm^{-3}$. Preferably the outer cushioning layer is formed of a foam material having a density of 30 $kgm^{-3}$.

The flexible cover may comprise an opening for accessing, inserting and removing the core from the cover, the opening comprising a fastenable seam extending around at least three sides of the body proximate one end, the seam including a fastener for closing the opening.

The fastener is preferably a zip fastener and the opening seam is preferably located between 20 mm and 40 mm inwardly from the proximate end. At this distance the zip fastener will not experience direct contact should the user impact the corner edge if the jump is not completed correctly, or direct impact at the intended inner landing zone, thereby minimizing the risk of damage to the zip. Preferably the opening seam is located 28 mm from the proximate end.

Each face of the cover preferably includes a perimeter section and a central panel secured to the perimeter and formed of a material having a greater coefficient of friction than the perimeter material. Providing a more durable and/or high friction material at the centre provides improved performance for the landing zone, without the requirement to form the entire apparatus from this heavier and more costly material. The central panels are preferably thermally welded to the perimeter sections.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF PREFERRED EMBODIMENTS

Figure 1:
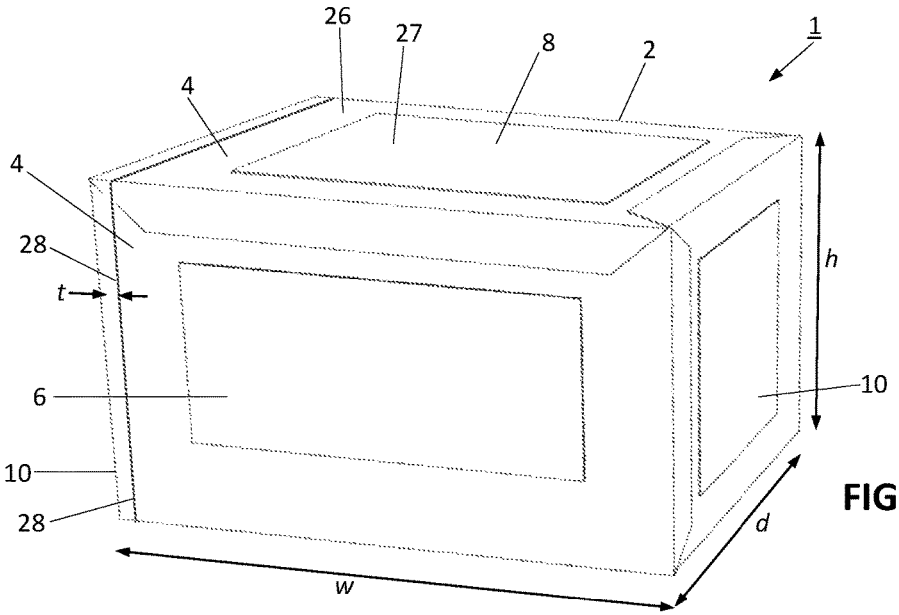
FIG. 1 shows a plyometric apparatus according to an embodiment of the present invention.
Figure 2:
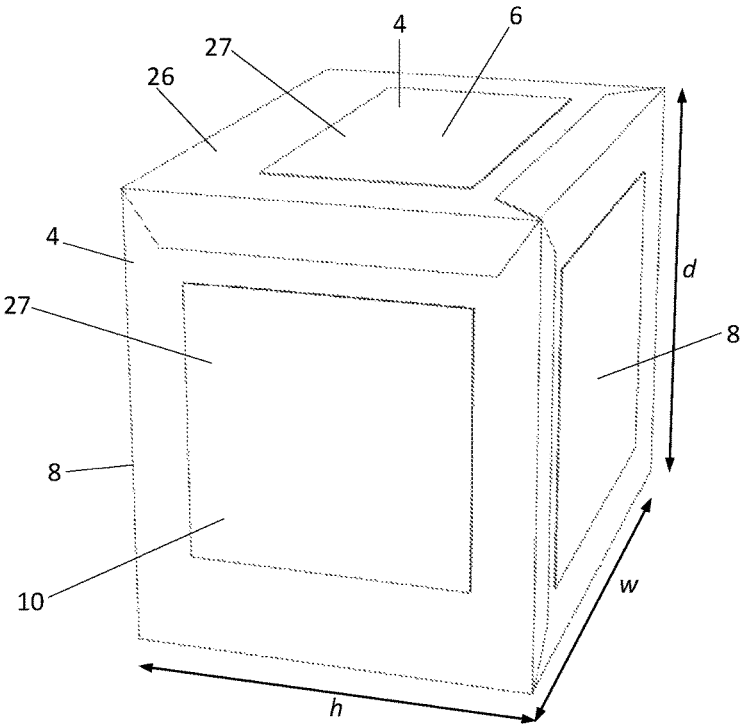
FIG. 2 shows the plyometric apparatus of FIG. 1 in the second of three orientations defining three varying heights.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

Referring to FIG. 1, a support apparatus 1 is provided to facilitate the performance of plyometric exercises. The support apparatus 1 comprises a cuboid shape body 2 having six rectangular faces 4. The six faces 4 comprise three pairs of opposing faces 6, 8 and 10. Each of the three pairs of opposing rectangular faces 6, 8 and 10 is different in size to the other two pairs, such that regardless of the orientation of the cuboid apparatus 1, the height, width and depth are always three different lengths.

In the orientation shown in FIG. 1 face 6 defines the front face of the cuboid apparatus 1, with the face 8 being one of the side faces and the face 10 defining the upper face. Each face has a correspondingly sized face on the opposing side of the cuboid. The width w of the cuboid corresponds to the longest side of the front face 6, and the height h corresponds to its shortest side. The depth d of the cuboid corresponds to the shortest side of the side face 8. The longest side of the side face 8 is the height h of the cuboid and corresponds to the shortest length of the front face 6. The depth d also defines the shortest side of the upper face 10, with the longest side of the upper face 10 corresponding to the width w and the longest side of the front face 6. The width w, height h and depth d are all different lengths, with each length being different from the other two.

The cuboid 1 may be arranged such that that it is supported on any one of the six faces 6, 8 and 10, with that face defining the base of the apparatus in that orientation. The height of the apparatus varies depending on which of the faces 6, 8 or 10 forms the base and correspondingly the upper face of the apparatus. As such, there are six alternative orientations that result in three different heights of the apparatus, the height being the vertical distance of the upper face from the base. Therefore, three jump platforms of varying height may be provided by the apparatus 1 of the present invention by simply reorienting the apparatus 1, rather than requiring three separating apparatus of varying heights.

In order for the apparatus to be used in any orientation, each of the faces 6, 8 and 10 must be suitable for use as a jump platform. Soft plyometric boxes of the prior art comprise a single dense foam upper layer located at the jump surface. Beneath the upper layer is provided a body formed from lower density foam with a greater compressibility than the upper layer. This arrangement provides a jump platform of suitable resilience that minimizes deformation and compression of the upper jump platform while also being soft enough to prevent impact injury. Meanwhile the lower density body provides cushioning beneath the upper panel, as well as minimizing the weight of the apparatus. An apparatus of this arrangement may only be used in a single orientation in which the dense foam layer is arranged at the upper surface.

Figure 3:
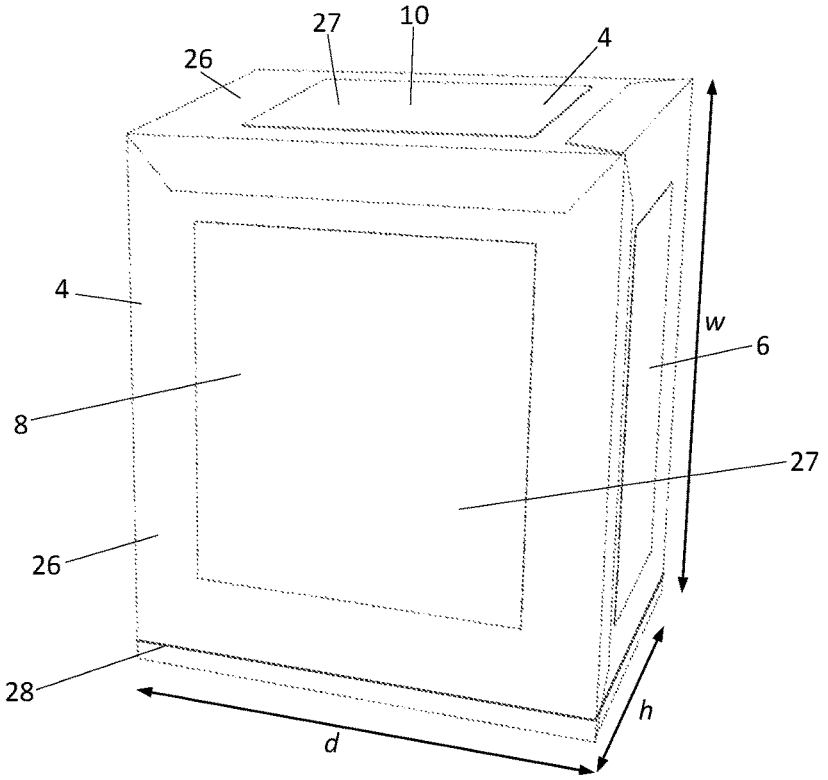
FIG. 3 shows the plyometric apparatus of FIG. 1 in the third of three orientations defining three varying heights.
Figure 4:
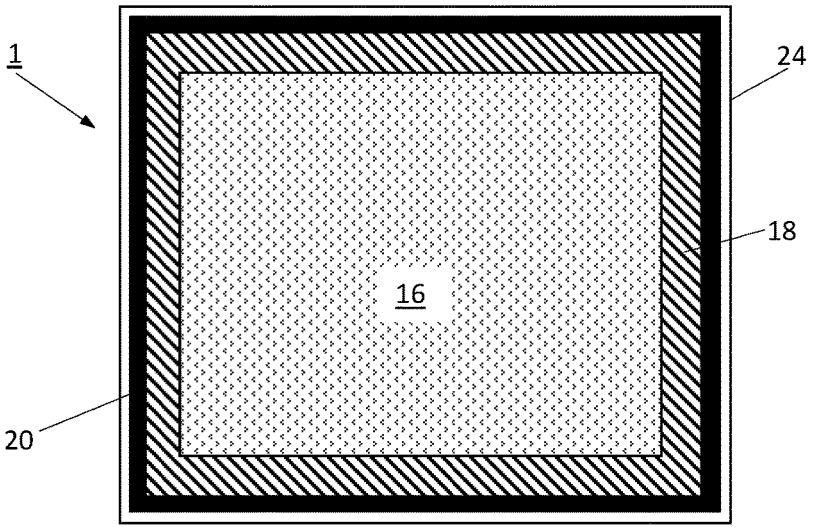
FIG. 4 is shows the internal core of a plyometric apparatus surrounding by an intermediate layer in accordance with an embodiment of the invention.

The present invention therefore provides a foam core surrounded on all sides by an intermediate layer of denser foam material. Specifically, as shown in FIG. 3, the apparatus 1 comprises a cuboid block core 16 formed of low density foam such as a Polyurethane foam having a density of approximately 33 $kgm^{-3}$. Surrounding the core is an intermediate layer 18 of rebounded foam, formed from polyurethane foam pieces, having a density of 120 $kgm^{-3}$, and a thickness of 38 mm. The intermediate layer is formed from six panels arranged and bonded to each of the six faces of the core 16 and to each of the adjacent panels along their coincident overlapping edges to surround and encapsulate the core 16. The rebounded foam of the intermediate layer 18 provides shock absorption to absorb the impact force when the user lands on the apparatus. The rebounded foam of the intermediate layer 18 is also sufficiently structurally rigid to maintain the form of the apparatus by minimizing overall compression across the height of the apparatus. In any orientation, the intermediate layer 18, by virtue of the fact it is arranged on every side of the apparatus, provides an upper horizontal surface supported vertically at all four edges by the vertical side panels of the intermediate layer 18, thereby resulting in significantly lower compressibility than is achieved where the upper surface is only supported vertically by a lower density foam material core.

A further outer layer 20 surrounds and encapsulates the intermediate layer 18. The outer foam layer 20 is formed from lower density foam than the intermediate layer 18, which may be a Polyethylene or Polyethylene Rebounded foam, and is preferably a reticulated polyethylene foam having a density of 30 $kgm^{-3}$. The thickness of the outer layer is approximately 20 mm, which is almost 50% thinner than the intermediate layer 18. The outer layer 20 provides a soft feel to the outer surface by providing a thin outer layer that is lighter and more compressible than the intermediate layer 18 beneath it. The outer layer 20 is formed from six panels bonded to the outer surface of the intermediate layer 18, between the intermediate layer 18 and the outer cover 24.

The layered foam body is surrounded by an outer cover 24 that is formed from a flexible but substantially inelastic material selected for its strength and tear resistance such as vinyl. Each comprises a perimeter section 26 formed from a first flexible cover material. Within the perimeter section is located a central panel 27 that is formed from a flexible cover material having a greater coefficient of friction relative to the perimeter section to provide a landing panel with increased grip, with the perimeter section being relatively smoother to minimize abrasion should a user slip and drag their legs along the outer edges.

To enable the cover 24 to be applied to and removed from the body, a zip fastener 28 is provide to enable one end of the cover 24 to be opened. The zip fastener 28 extends around four adjacent sides of the cover proximate and parallel to one proximate adjacent end running parallel to the edges surrounding that end. The zip fastener 28 is spaced a distance t of approximately 20-40 mm from the closest end face, and preferably at a distance t of 28 mm. This spacing has been found to be optimum as it distances the zip far enough from the edge to ensure that the zip fastener 28 is not forced open by direct contact with the edge by a user. The spacing is also small enough that the zip fastener 28 is maintained sufficiently far from the main landing panel 26 that impact forces to not pull directly on the zip 28 causing it to open or tear. The zip fastener 28 is also covered by elongate flaps 30 located either side of the zip 28 along each side thereby preventing direct contact with the zip 28 to prevent damage to the zip 28 and potential abrasion to the user.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A support apparatus for use during plyometric exercise comprising a resilient body having a cuboid shape, wherein the cuboid body has a height, width and depth which are all of different lengths to each other such that the apparatus may be arranged in three different orientations in which the uppermost face defines a landing platform of three different heights, and wherein the body comprises a shock absorbing layer formed of a resilient material located at all six sides of the apparatus such that a shock absorbing layer is located at the upper face of the apparatus to define a landing platform whatever the orientation of the apparatus, wherein said support apparatus further comprises a flexible cover surrounding the resilient body and an outer cushioning layer surrounding and encapsulating the shock absorbing layer between the intermediate layer and the flexible cover.

2. The support apparatus according to claim 1 comprising a core and wherein the shock absorbing layer is located at the outer surface of the core.

3. The support apparatus according to claim 2, wherein the shock absorbing layer has a density greater than the core.

4. The support apparatus according to claim 3, wherein the core and the shock absorbing layer are formed from a foam material.

5. The support apparatus according to claim 3, wherein the shock absorbing layer is bonded to the outer surface of the core.

6. The support apparatus according to claim 1, wherein the outer cushioning layer is bonded to the shock absorbing layer.

7. The support apparatus according to claim 1, wherein the core is formed of a polyethylene foam material.

8. The support apparatus according to claim 1, wherein the shock absorbing layer is formed of a foam material having a density of between 100 $kgm^{-3}$ and 140 $kgm^{-3}$.

9. The support apparatus according to claim 1, wherein the shock absorbing layer is formed of a foam material having a density of 120 $kgm^{-3}$.

10. The support apparatus according claim 1, wherein the outer cushioning layer is formed of a foam material having a density of between 20 $kgm^{-3}$ and 40 $kgm^{-3}$.

11. The support apparatus according to claim 1, wherein the outer cushioning layer is formed of a foam material having a density of 30 $kgm^{-3}$.

12. The support apparatus according to claim 1, wherein the flexible cover comprises an opening for accessing inserting and removing the core from the cover, the opening comprising a fastenable seam extending around at least three sides of the body proximate one end, the seam including a fastener for closing the opening.

13. The support apparatus according to claim 12, wherein the opening seam is located between 20 mm and 40 mm inwardly from the proximate end.

14. The support apparatus according to claim 13, wherein the opening seam is located 28 mm from the proximate end.

15. A support apparatus for use during plyometric exercise comprising a resilient body having a cuboid shape, wherein the cuboid body has a height, width and depth which are all of different lengths to each other such that the apparatus may be arranged in three different orientations in which the uppermost face defines a landing platform of three different heights, and wherein the body comprises a shock absorbing layer formed of a resilient material located at all six sides of the apparatus such that a shock absorbing layer is located at the upper face of the apparatus to define a landing platform whatever the orientation of the apparatus, wherein said support apparatus further comprises a flexible cover surrounding the resilient body, wherein each face of the flexible cover includes a perimeter section and a central panel secured to the perimeter, and wherein the perimeter section and central panel are formed of materials having different coefficients of friction.

16. The support apparatus according to claim 15, wherein the central panels are formed of a material having a greater coefficient of friction than the perimeter material.

17. The support apparatus according to claim 15, wherein the central panels are thermally welded to the perimeter sections.

* * * * *